United States Patent [19]

Sacchi

[11] 4,371,320

[45] Feb. 1, 1983

[54] SEMI-ROTARY HYDRAULIC PUMP

[76] Inventor: Giulio Sacchi, Viale Bruno Buozzi 109, Roma, Italy

[21] Appl. No.: 170,900

[22] Filed: Jul. 21, 1980

[30] Foreign Application Priority Data

Jul. 23, 1979 [IT] Italy ..... 24557 A/79

[51] Int. Cl.[3] ..... F04B 19/00; F04B 29/00

[52] U.S. Cl. ..... 417/461; 417/482

[58] Field of Search ..... 417/462, 460, 461, 466, 417/467, 468, 481, 482, 483, 484; 92/119, 117, 118, 120, 121, 122; 418/160, 68

[56] References Cited

U.S. PATENT DOCUMENTS 3,747,578 7/1973 Pickens ..... 92/119 X 3,973,469 8/1976 Humen ..... 92/119 X

*Primary Examiner*—William L. Freeh

*Attorney, Agent, or Firm*—Fleit & Jacobson

[57] ABSTRACT

A semi-rotary pump having a spherical pump body (4) mounted for rotation within a supporting housing (1) about an axis (X—X).

A sector (5), having two diametrically opposed segment portions (6,7), is mounted for oscillation within the pump body about an oscillation axis (Z—Z) perpendicular to said axis (X—X).

The pumping action and the auto-distribution are caused by simultaneous oscillations of the sector and pump body by means of a continuously rotating drive shaft (31).

5 Claims, 5 Drawing Figures

SEMI-ROTARY HYDRAULIC PUMP

BACKGROUND OF THE INVENTION

The present invention relates to a double acting reciprocating hydraulic pump, comprising a pump body within which there is mounted a sector which oscillates about an axis and which acts as a piston. In the art this type of hydraulic pump is called a semi-rotary pump.

In known semi-rotary pumps the pump body is generally a fixed cylinder and having two distributor valves, the valve members of one valve being formed in the oscillating sector, and the valve members of the other valve being formed in the inlet duct of the pump. Operation of the oscillating sector is effected manually. Such pumps work satisfactorily only at low frequencies, for which reason their range of application is extremely limited; in practice these semi-rotary pumps have been utilised only for transferring liquid from one container to another.

When a consistent head, good operational reliability and high delivery rates are required it has previously been necessary to utilise rotary pumps of the axial piston type in which the pistons are arranged in a cylinder block which rotates about an axis coincident with the axis of the drive shaft of the pump (in-line pumps) or alternatively rotates about an axis inclined with respect to the drive axis of the pump (bent-axis pumps).

These rotary pumps have automatic valve gear for the auto-distribution of hydraulic fluid by one of the following techniques:

by means of appropriate openings in communication with one another and formed in the cylinder block, which openings are further in communication, respectively, with the outlet and the inlet of the pump and are uncovered by the movement of the pistons relative to the cylinder block;

by means of automatic valves provided on the output and by means of auto-distribution with openings provided in the inlet.

Such pumps have very complex structural and functional characteristics, require accurate manufacture of all their components, have to be made of appropriate materials, in particular suitable low-friction metal alloys, for example an alloy of silver, antimony and tin, particularly for the manufacture of the relatively movable parts. Such pumps also require accurate and frequent maintenance, and consequently these pumps are expensive to manufacture, to operate and to maintain.

The main object of the present invention is to provide a semi-rotary pump which is usable for medium and high heads, with a reliability and an efficiency least comparable with those of the known rotary pumps referred to above, but with structural and functional characteristics significantly simpler than the said known pumps.

SUMMARY OF THE INVENTION

According to the invention there is provided a semi-rotary hydraulic pump comprising a pump body having a liquid inlet and a liquid outlet, a sector mounted for angular oscillation within the body about an axis of oscillation, and abutment stop means for limiting the angular displacements of the said sector within the body, wherein the pump further comprises: a fixed support on which the said pump body is mounted for rotation about the axis of oscillation of the said sector by means of two swivel bearings formed on respective coaxial tubular bosses which are carried by said support, and which afford communication between the interior of the said pump body and the inlet and outlet respectively; valve means essentially constituted by a plurality of liquid flow passages formed in the said swivel bearings, and drive means for effecting synchronous angular displacement of the said pump body and the said sector.

In a preferred embodiment of the invention the pump body is spherical and the said sector consists essentially of a single member having spherical segment portions extending symmetrically with respect to a shaft which is coaxial with the said axis of oscillation.

BRIEF DESCRIPTION OF THE DRAWINGS

The present invention will now be more particularly described, by way of example, with reference to the accompanying drawings, in which.

DESCRIPTION OF A PREFERRED EMBODIMENT

Figure 1:
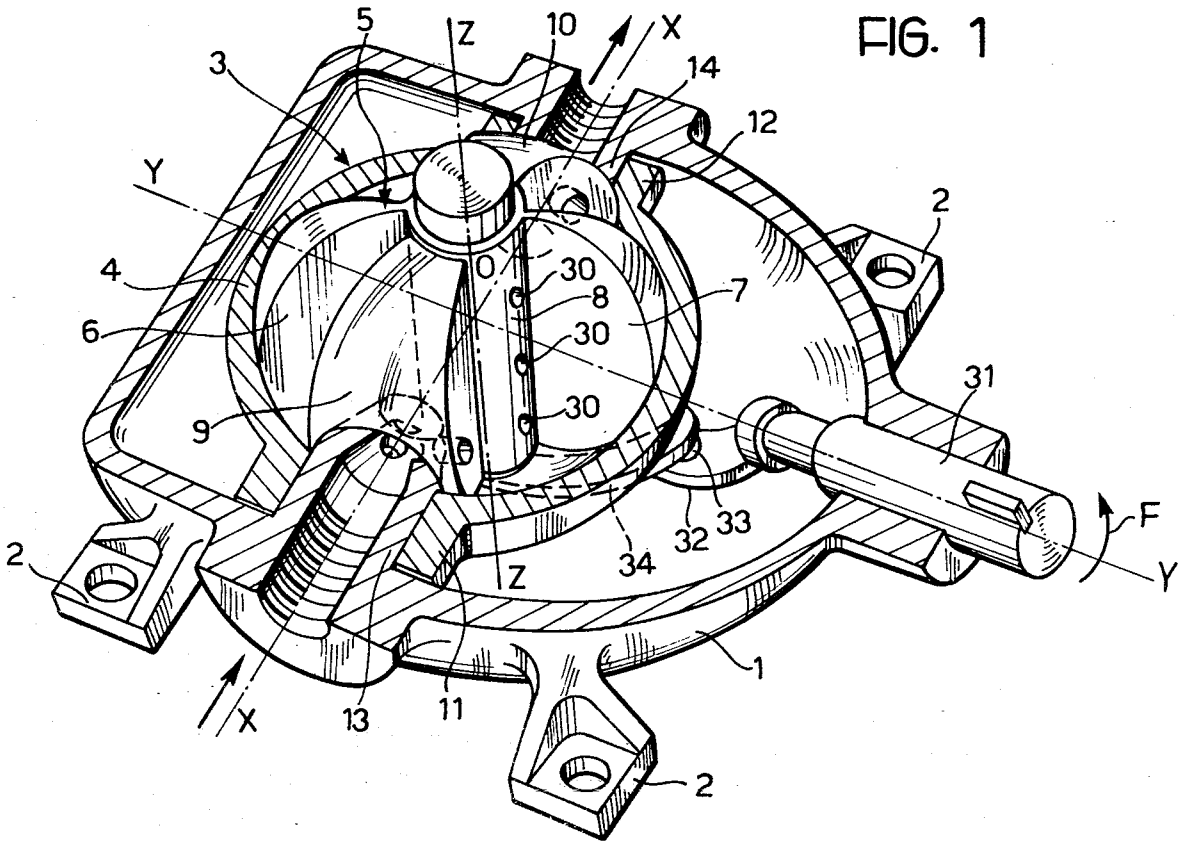
FIG. 1 is a partially sectioned perspective view of a semi-rotary hydraulic pump according to one embodiment of the invention.

With reference to the drawings, the illustrated pump has an outer supporting casing 1 having four small feet 2 for fixing the casing to a base (not shown). Within the casing 1 there is mounted, in a manner which will be described in greater detail below, a semi-rotary hydraulic pump according to the invention, generally indicated 3. The pump 3 comprises a spherical pump body 4 within which there is mounted a spherical sector 5 which is angular displaceable in either direction about an axis Z—Z of the spherical pump body 4. In the following description the axis Z—Z will be referred to as the axis of oscillation of the sector 5.

The sector 5 comprises a single body having two diametrically opposed spherical segment portions 6, 7 extending symmetrically from a central shaft 8 which is coaxial with the said axis of oscillation Z—Z. In order to limit the angular displacements of the sector 5 in the two senses of rotation, two positive abutment stops 9, 10 also shaped as spherical segments and of the same angular width as the segment portions 6, 7 are fixed within the pump body 4 and in diametrically opposite positions.

The radially inner walls of the positive abutment stops 9, 10 which face each other have cross sections in the form of arcs of a circle which together define partly cylindrical bearing surfaces in which the shaft 8 of the sector 5 is rotably supported, the dimensions being such that these bearing surfaces provide liquid-tight seals.

The pump body 4 is provided with two coaxial cylindrical necks 11, 12 in diametrically opposite positions coincident with the positions of the positive abutment stops 9 and 10. By means of these necks 11, 12 the pump body 4 is supported rotationally on two tubular coaxial bosses 13, 14 which are identical with each other and carried on the outer casing 1. The common axis X—X of these bosses 13, 14 is perpendicular to the axis of oscillation Z—Z of the sector 5.

Figure 2:
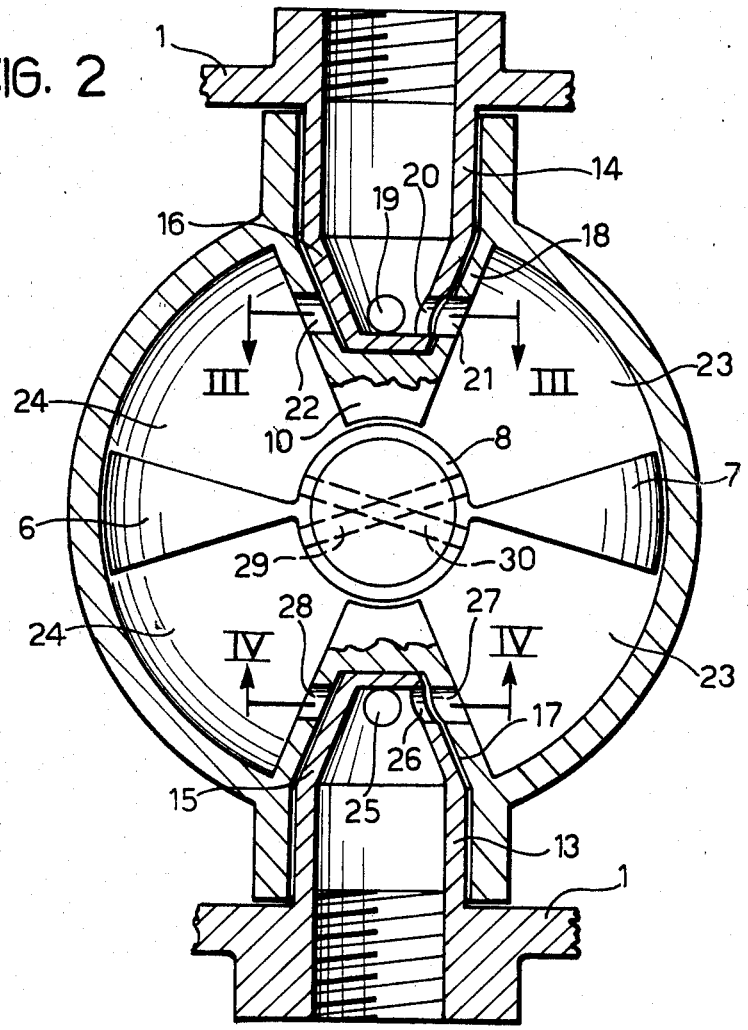
FIG. 2 is a partly cut-away plan view of the pump illustrated in FIG. 1.

The bosses 13, 14 have frusto-conical inner end portions 15, 16 which form liquid-tight seals with and are rotatably engaged in respective conical seats 17, 18 formed radially in the abutment stops 9 and 10 respectively, as can be best seen in FIG. 2.

Figure 3:
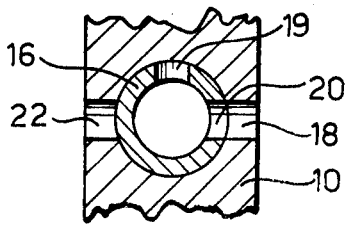
FIGS. 3 and 4 are cross sections taken on the lines III—III and IV—IV respectively in FIG. 2.
Figure 5:
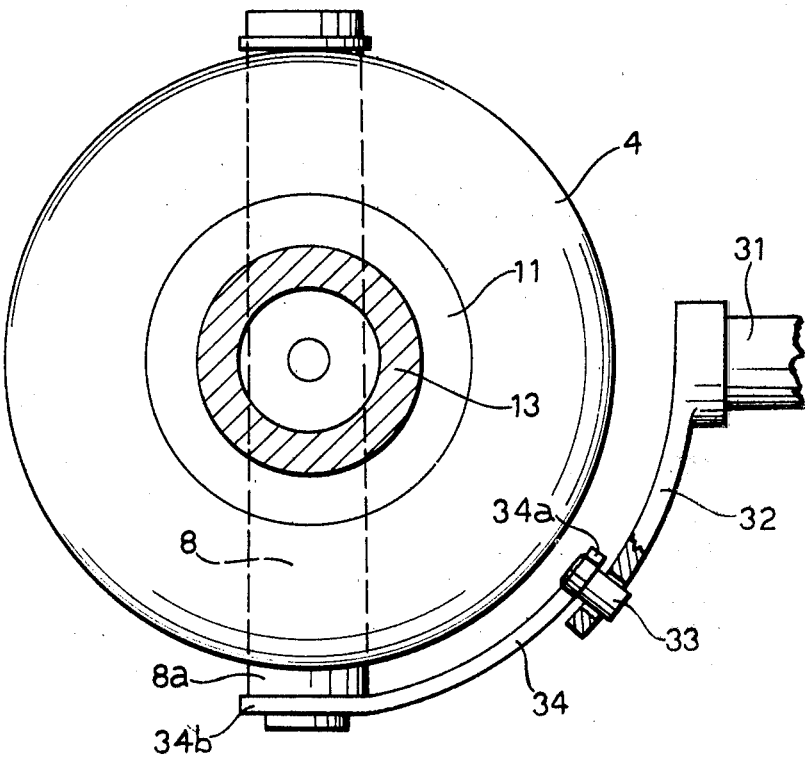
FIG. 5 is a side view of the hydraulic pump of FIG. 1.
Figure 4:
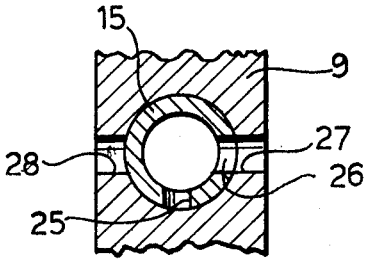

With reference to FIGS. 2, 3 and 4, liquid flow passages 19, 20 are formed in the frusto-conical end portion 16 of the boss 14, the passages 19, 20 being substantially perpendicular to each other for alignment alternately with passages 21, 22 formed in the abutment stop 10 and opening into the said conical seat 18. The passage 21 opens into the chamber 23 in which the spherical segment portion 7 of the sector 5 moves, whilst the passage 22 opens into the chamber 24 in which the spherical segment portion 6 of the sector 5 moves.

The frusto-conical end portion 15 of the boss 13 is formed with passages 25, 26 having axes substantially perpendicular to each other for alignment alternately with passages 27, 28 formed in the positive abutment stop 9. The said passages 27 and 28 open into the conical seat 17 which receives said conical portion 15, and open respectively into the aforesaid chambers 23 and 24.

The passages 19, 20, 21, 22, 25, 26, 27 and 28 form the distributor valve of the hydraulic pump of this invention, together with a series of passages, indicated in broken outline with the reference numerals 29 and 30, formed radially in the shaft 8 in order to put the liquid in the chambers 23, 24 in communication with each other across the sector 5.

The bosses 13, 14 communicate respectively with the inlet and outlet of the pump. A drive shaft 31, driven by conventional means (not shown), is rotatably supported by the outer casing 1. The axis of rotation Y—Y of this shaft 31 intersects the axis of oscillation Z—Z of the sector and is perpendicular to the axis X—X of the bosses 13, 14 and, therefore, to the swivel axis of the spherical pump body 4 on the said bosses. The inner end of the drive shaft 31, within the casing 1, carries one end of an arcuate lever 32 the other end of which is articulated, by means of a pivot pin 33, to the free end 34*a* of an arcuate connecting arm 34. The other end 34*b* of the connecting arm 34 is fixed to a portion 8*a* of the shaft 8 which projects outwardly from the pump body 4.

In accordance with a preferred, but not essential, condition, the axis of rotation Y—Y of the shaft 31, the axis of oscillation Z—Z of the sector 5, the swivel axis X—X of the pump body 4 on the bosses 13, 14 and the axis of the pivot pin 33 all pass through the centre of the spherical pump body 4.

By rotatably driving the shaft 31 in the sense indicated by the arrow F of FIG. 1, the pivot pin 33, which constitutes the pivotal connection between the lever 32 and the connecting arm 34, describes a circular trajectory about the axis of rotation of the drive shaft 31, drawing with it the end 34*a* of the connecting arm 34. The other end 34*b* of the connecting arm 34, which is connected to the shaft 8 of the sector 5 and, therefore to the pump body 4, is subjected to angular oscillations and, simultaneously, to displacements in the direction of the line which at any time joins the end 34*b* with the pivot pin 33. Consequently the connecting arm 34 translates the continuous rotation of the drive shaft 31 into an angular oscillation of the sector 5 about the axis Z—Z and a simultaneous angular rocking movement of the spherical pump body 4 about the axis X—X of rotation of this body on the bosses 13, 14.

The angular displacements of the sector 5 within the body 4 cause the pumping of liquid from an inlet through the tubular boss 13 to the outlet through the tubular boss 14. The angular displacements of the spherical pump body 4 and of the abutment stops 9, 10 rigidly connected thereto cause the desired valve operation in phase with the said pumping action.

The semi-rotary hydraulic pump herein described is thus particularly effective for pumping medium to high heads of liquid, providing a delivery and a reliability comparable with, if not greater than that of prior art rotary pumps, compared with which the hydraulic pump of the present invention has structural characteristics which are significantly simpler. The pump is therefore more economical to manufacture than prior art pumps. The constructional simplicity of the components of the pump of this invention, and its simple operating characteristics, are such that the pump does not require specialised maintenance.

A further and not insignificant advantage of the pump of the present invention lies in its compactness due chiefly to its essentially spherical conformation and its valve arrangement.

What I claim is:

1. A semi-rotary hydraulic pump for pumping a liquid, said pump comprising:

a spherical pump body having a hollow interior, a liquid inlet, and a liquid outlet;

two spherical segment abutment stop portions fixed in diametrically opposite positions within the interior of said spherical pump body and which divide the interior of said pump body into first and second pumping chambers;

a sector mounted within said interior of said pump body, said sector having a sector shaft and two integrally formed spherical segment portions extending symmetrically with respect to said sector shaft, one of said spherical segment portions extending into each of said pumping chambers and dividing each pumping chamber into an inlet portion adjacent to said liquid inlet, and an outlet portion adjacent to said liquid outlet;

means for fluid communication between said inlet portion of each pumping chamber and said outlet portion of the other pumping chamber;

a first axis of oscillation coaxial with the axis of said sector shaft;

means for mounting said sector to allow said sector to oscillate about said first axis of oscillation;

a first pressure section formed by said inlet portion of said first pumping chamber and said outlet portion of said second pumping chamber;

a second pressure section formed by said inlet portion of said second pumping chamber and said outlet portion of said first pumping chamber;

said oscillation of said sector about said first axis of oscillation alternately causing an increase in volume in one of said first and second pressure sections, thereby creating a low pressure section, and causing a corresponding decrease in volume in the other of said first and second pressure sections, thereby creating a high pressure section;

a fixed support for supporting said pump body;

a conical seat formed in each of said spherical segment abutment stop portions;

two tubular bosses having a frusto-conical end portion formed on opposite sides of said spherical pump body;

a second axis of oscillation coaxial with the common axis of said tubular bosses and perpendicular to said first axis of oscillation;

two swivel bearings formed by said tubular bosses and said conical seats, said bearings allowing said pump body to oscillate about said second axis of oscillation;

valve means having a plurality of liquid flow passages formed in said swivel bearings, said oscillation about said second axis of oscillation placing said liquid flow passages in alignment allowing fluid communication between said liquid inlet and said low pressure section and between said liquid outlet and said high pressure section through the passages thus formed; and drive means for causing the oscillations about said first and second axes of oscillation, said oscillations synchronized with regard to each other so that said liquid is drawn from said inlet through said valve means into said low pressure section and is expelled from said high pressure section through said valve means and said pump outlet.

2. A semi-rotary hydraulic pump as claimed in claim 1, wherein said spherical segment abutment stop portions have oppositely facing surfaces having part-circular cross sections defining within the said pump body a cylindrical seat in which the shaft of the said oscillatory sector is rotatably supported with a liquid-tight seal.

3. A semi-rotary hydraulic pump for pumping a liquid, said pump comprising:

a pump body having a hollow interior, a liquid inlet, and a liquid outlet;

abustment stop means which divide the interior of said pump body into first and second pumping chambers;

a sector mounted within said interior of said pump body having a shaft extending outwardly of said pump body, said sector extending into each of said pumping chambers and dividing each pumping chamber into an inlet portion adjacent to said liquid inlet, and an outlet portion adjacent to said liquid outlet;

means for fluid communication between said inlet portion of each pumping chamber and said outlet portion of the other pumping chamber;

a first axis of oscillation coaxial with the axis of said shaft of said sector;

means for mounting said sector to allow said sector to oscillate about said first axis of oscillation;

a first pressure section formed by said inlet portion of said first pumping chamber and said outlet portion of said second pumping chamber;

a second pressure section formed by said inlet portion of said second pumping chamber and said outlet portion of said first pumping chamber;

said oscillation of said sector about said first axis of oscillation alternately causing an increase in volume in one of said first and second pressure sections, thereby creating a low pressure section, and causing a corresponding decrease in volume in the other of said first and second pressure sections, thereby creating a high pressure section;

a fixed support for supporting said pump body;

two coaxial tubular bosses formed on opposite sides of said pump body defining a second axis of oscillation coaxial with the common axis of said tubular bosses and perpendicular to said first axis of oscillation;

two swivel bearings formed by said respective tubular bosses with said fixed support, said bearings supporting said pump body for oscillation about a second axis of oscillation;

valve means having a plurality of liquid flow passages formed in said swivel bearings, said oscillation about said second axis of oscillation placing said liquid flow passages in alignment allowing fluid communication between said liquid inlet and said low pressure section and between said liquid outlet and said high pressure section through the passages thus formed;

drive means having a drive shaft carried by said fixed support;

an arcuate connecting arm;

an arcuate lever, one end of said arcuate lever being fixedly attached to one end of said drive shaft, and the other end of said arcuate lever being articulated to the free end of said arcuate connecting arm, the second end of said arcuate connecting arm being connected to said shaft of said sector where said shaft projects outwardly from said pump body; and said drive means causing said oscillations about said first and second axes of oscillation, said oscillations synchronized with regard to each other so that said liquid is drawn from said inlet through said valve means into said low pressure section and is expelled from said high pressure section through said valve means and said pump outlet.

4. A semi-rotary hydraulic pump for pumping a liquid, said pump comprising:

a pump body having a hollow interior, a liquid inlet, and a liquid outlet;

abutment stop means which divide the interior of said pump body into first and second pumping chambers;

a sector mounted within said interior of said pump body, extending into each of said pumping chambers and dividing each pumping chamber into an inlet portion adjacent to said liquid inlet, and an outlet portion adjacent to said liquid outlet;

means for fluid communication between said inlet portion of each pumping chamber and said outlet portion of the other pumping chamber;

means for mounting said sector to allow said sector to oscillate about said first axis of oscillation;

a first pressure section formed by said inlet portion of said first pumping chamber and said outlet portion of said second pumping chamber;

a second pressure section formed by said inlet portion of said second pumping chamber and said outlet portion of said first pumping chamber, said oscillation of said sector about said first axis of oscillation alternately causing an increase in volume in one of said first and second pressure sections, thereby creating a low pressure section, and causing a corresponding decrease in volume in the other of said first and second pressure sections, thereby creating a high pressure section;

a fixed support for supporting said pump body;

two coaxial tubular bosses formed on opposite ends of said body, a second axis of oscillation coaxial with the common axis of said tubular bosses and perpendicular to said first axis of oscillation;

two swivel bearings formed by said respective tubular bosses with said fixed support, said bearings supporting said pump body for oscillation about said second axis of oscillation;

valve means having a plurality of liquid flow passages formed in said swivel bearings, said oscillation about said second axis of oscillation placing said liquid flow passages in alignment allowing fluid communication between said liquid inlet and said low pressure section and between said liquid outlet and said high pressure section through the passages thus formed; and drive means for causing the oscillations about said first and second axes of oscillation, said oscillations synchronized with regard to each other so that said liquid is drawn from said inlet through said valve means into said low pressure section and is expelled from said high pressure section through said valve means and said pump outlet.

5. A semi-rotary hydraulic pump as claimed in claim 4, in which the said pump body is spherical and the said sector is formed by a single member having two spherical segment portions extending symmetrically with respect to a shaft which is coaxial with the said first axis of oscillation.

* * * * *